United States Patent [19]

Pizzicara

[11] Patent Number: 4,920,934

[45] Date of Patent: May 1, 1990

[54] ROTARY VALVE INTERNAL COMBUSTION ENGINE

[75] Inventor: Marco Pizzicara, Brescia, Italy

[73] Assignee: Duebi S.R.L., Varese, Italy

[21] Appl. No.: 360,391

[22] Filed: Jun. 2, 1989

[30] Foreign Application Priority Data

Jun. 9, 1988 [IT] Italy ..... 3498 A/88

[51] Int. Cl.[5] ..... F01L 7/00

[52] U.S. Cl. ..... 123/80 BA; 123/193 CH; 123/190 B; 123/190 BB

[58] Field of Search ..... 123/80 BA, 190 E, 190 BB, 123/190 B, 193 CH, 193 CP, 193 C

[56] References Cited

U.S. PATENT DOCUMENTS 3,948,227 4/1976 Guenther ..... 123/190 B
4,517,938 5/1985 Kruger ..... 123/190 E
4,699,100 10/1987 Leydorf, Jr. et al. ..... 123/193 CH

FOREIGN PATENT DOCUMENTS 3241722 11/1982 Fed. Rep. of Germany .

*Primary Examiner*—E. Rollins Cross
*Attorney, Agent, or Firm*—Fay, Sharpe, Beall, Fagan, Minnich & McKee

[57] ABSTRACT

The engine comprises three basic parts, of which one is the crankcase; the others consist in at least one modular liner-and-head casting, of which the liner part is accommodated slidably and to a fluid-tight in a respective bore afforded by the crankcase, and a cylindrical element accommodated freely and rotatably in a through hole formed from matched openings in the walls of the crankcase and in each modular cylinder head, in such a way that it functions additionally as a pin by means of which to assemble the modular components.

10 Claims, 3 Drawing Sheets

ROTARY VALVE INTERNAL COMBUSTION ENGINE

BACKGROUND OF THE INVENTION

The invention relates to an internal combustion engine of rotary valve design, in which the sealing of compressed gases is achieved automatically. The state of the art as discernible from technical literature demonstrates that the limitations on internal combustion engines, in terms of noise levels and running speed, are dictated at least in part by the embodiment of the inlet and exhaust valves by which operation of the engine is adjusted and controlled; such an observation applies to Otto and Diesel units alike.

Current literature similarly shows that the means of overcoming such limitations lie in the adoption of rotary valves to replace the conventional poppet type.

More exactly, the traditional poppet valve is a reciprocating component, returned by spring means; thus, the number of cycles it is able to accomplish necessarily depends on the properties of the spring means, and its service life is ultimately limited. Moreover, the reciprocating movement of the poppet valve is such as to produce a metal-on-metal impact at the end of each stroke, hence a certain level of noise.

By contrast, the movement of a rotary valve permits of obtaining particularly high running speeds and singularly low noise levels, since no spring return means are employed, and there is no stroke impact. Furthermore, rotary valves are capable of offering greater cross sectional areas to the flow of gases, thereby increasing efficiency of the engine; again, with the rotary valve design, combustion chambers can be made more compact and positioned directly in the flow path of inlet and exhaust gases.

On the debit side, rotary type valves are beset by a problem as yet unresolved, namely, that of their unsatisfactory sealing action, which is so poor in practice as render them unsuitable for the mass production of internal combustion engines. Faultless sealing action is in fact indispensable to correct operation of the engine, inasmuch a loss of pressure from the combustion chamber results in loss of output, hence in substandard operation of the engine as a whole.

Securing an efficient sealing action, difficult enough in rotating parts generally, becomes still more problematical in the case of the i.c. engine, given that pressure and temperature are cyclic rather than constant, and reach particularly high values.

The difficulty in question is also attested by the considerable number of patent specifications that have been published on the subject, most of which disclosing sophisticated and complicated sealing arrangements which not only fail to offer a full solution to the problem, but are quite unacceptable from the cost standpoint.

For example, application DE-OS No. 3241722 for German patent sets forth the expedient of hardening one of the valve's two mating surfaces and dry-lubricating the other, which is less hard. Hardening is brought about by a variety of techniques from quenching of the bare metal to application of a ceramic facing, or again, using a separate bushing fitted with the assistance of force or heat; the dry lubrication is achieved with carbon or molybdenum sulphide. Clearly enough, such a remedy is so costly and difficult to implement as to be suitable only for special applications where the time and expense can be justified; similarly, purpose-designed, costly equipment is required in servicing such seals. U.S. Pat. No. 4,517,938 discloses a rotary valve device in which use is made of numerous rings, and of dry seals associated with the valve bearings. Here too, the parts in mating contact are variously embodied in materials including sintered, carbon, and those with a low coefficient of thermal expansion or low conduction of heat.

Whether in the case of the references cited above, or of others not mentioned though directed toward this same question of improving the sealing action of rotary valves, none of the expedients proposed succeed in providing a technically complete and rationally comprehensive solution to the problem; at all events, the resulting prior art consists in methods based on the use of an extensive number of interconnected components, the failure of just one of which can adversely affect smooth operation of the engine as a whole, and besides, there is the basic cost of the single components, which clearly adds to the cost of the assembled engine.

Accordingly, the object of the present invention is to provide a definitive solution to the problem of poor sealing action in rotary valves for internal combustion engines, with such a degree of economy as will justify its adoption on industrial scale, not only from the manufacturing standpoint, but also from that of subsequent servicing; in effect, the necessary operations can be performed by semi-skilled persons and without any need for special equipment.

It is an additional object of the invention to design an internal combustion engine with rotary inlet and exhaust valves the construction of which is such as to permit a significant reduction in the cost of manufacture, thanks to a reduction in the number of parts, and ensure lower noise levels with the engine running.

SUMMARY OF THE INVENTION

The stated object is achieved with a rotary valve internal combustion engine according to the present invention.

The engine disclosed is embodied essentially in three parts: a crankcase; one or more cylindrical liners accommodated slidably in a respective bore of the crankcase; and a shaft, or valve element, accommodated rotatably in a continuous hole formed in the walls of the crankcase and the heads of the liners, thus providing means by which the crankcase and liners are assembled one with the other.

The main advantage of the invention is essentially that of the constructional simplicity of the engine as a whole; in effect, assembly is achieved without the use of a single bolt, at least as regards the crankcase and cylinder head (as recognizable in a conventional engine).

A further advantage of the engine according to the invention is that of the efficiency of the valve sealing action, given that the action is that much firmer, the greater the pressure internally of the axial bore of the cylindrical liners, i.e. of the combustion chambers.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 4B:
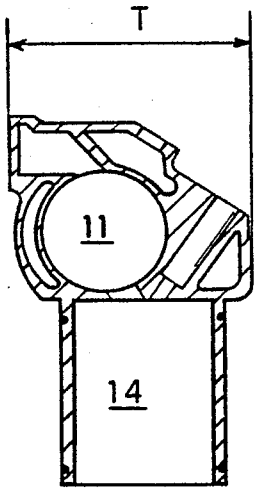
FIG. 4(*a–c*) shows the basic components of the engine and valve assembly according to the invention.
Figure 4C:
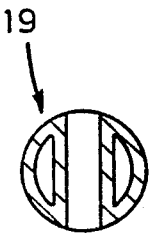

With reference to the drawings, the basic structure of an internal combustion engine according to the invention comprises three essential components:

a crankcase 2;

one or more cylinder liner sections 8;

a valve element, or rotor 19 (FIG. 4*c*).

The crankcase 2 affords at least one bore 3 (FIG. 1) preferably of cylindrical embodiment, extending from an enclosure 4 occupied by the crankshaft 5 of the engine, which passes through and is supported by the crankcase walls 6.

Figure 4A:
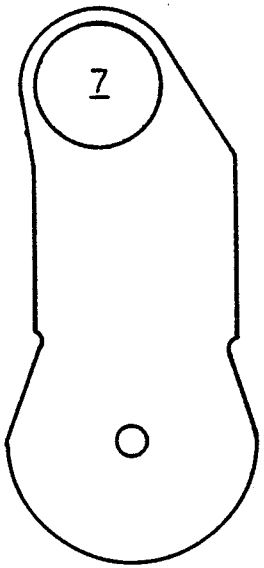

The crankcase also affords at least two coaxial holes 7, located at the end of bores 3 farthest from the enclosure 4 (see also FIG. 4*a*) the axes of which are disposed parallel with the axis of the crankshaft 5.

The crankcase 2 may be cast integrally with one or more bores 3, or fabricated from a plurality of matched modular units 22 each affording at least one bore 3, at least one enclosure 4 and at least two holes 7, in which case the walls 6 of the single unit 22 encompassing the enclosure 4 will accommodate the crankshaft 5. Whereas, throughout the specification, reference is made simply to "the crankcase 2" as a single component, this may be taken to denote either the one-piece casting or an assembly of modular units 22.

The liner sections 8, of which one is provided for each bore 3 afforded by the crankcase, are modular in embodiment and of diameter (or of dimensions) such as to insert slidably in the relative bore 3, preferably to a fluid-tight fit.

Each liner section 8 affords an axial bore 14, of which the open bottom end is offered to a relative enclosure 4 of the crankshaft 2, and the top end merges with a head casting 10 (see also FIG. 4*b*). 9 denotes a piston, slidably accommodated by each axial bore 14 and connected mechanically to the crankshaft 5, and combining with the bore 14 and the head 10 to create a combustion chamber 21, as will become clear in due course.

11 denotes a cylindrical hole passing through the head 10 transversely to the axis of the bore 14, disposed in alignment with the holes denoted 7 and substantially of identical diameter.

Figure 2:
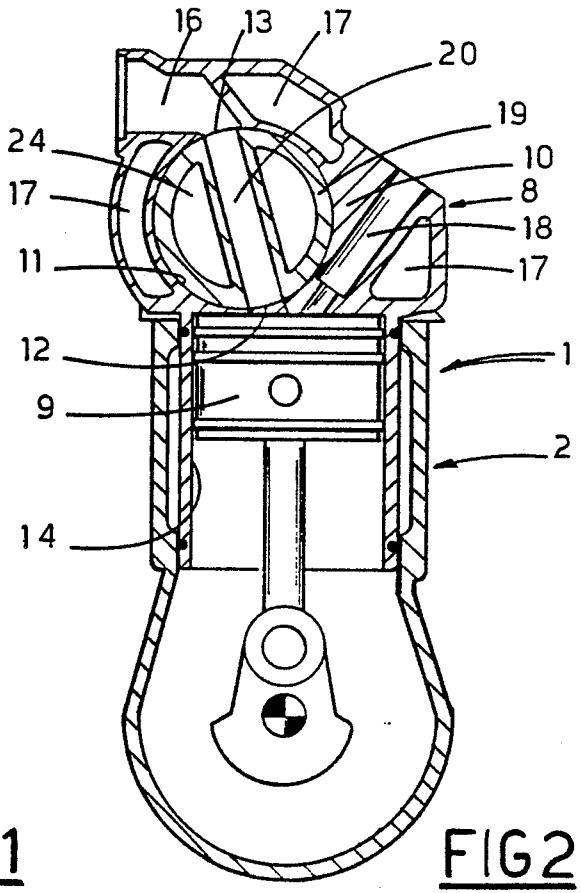
FIG. 2 is the section through II—II of FIG. 1.
Figure 1:
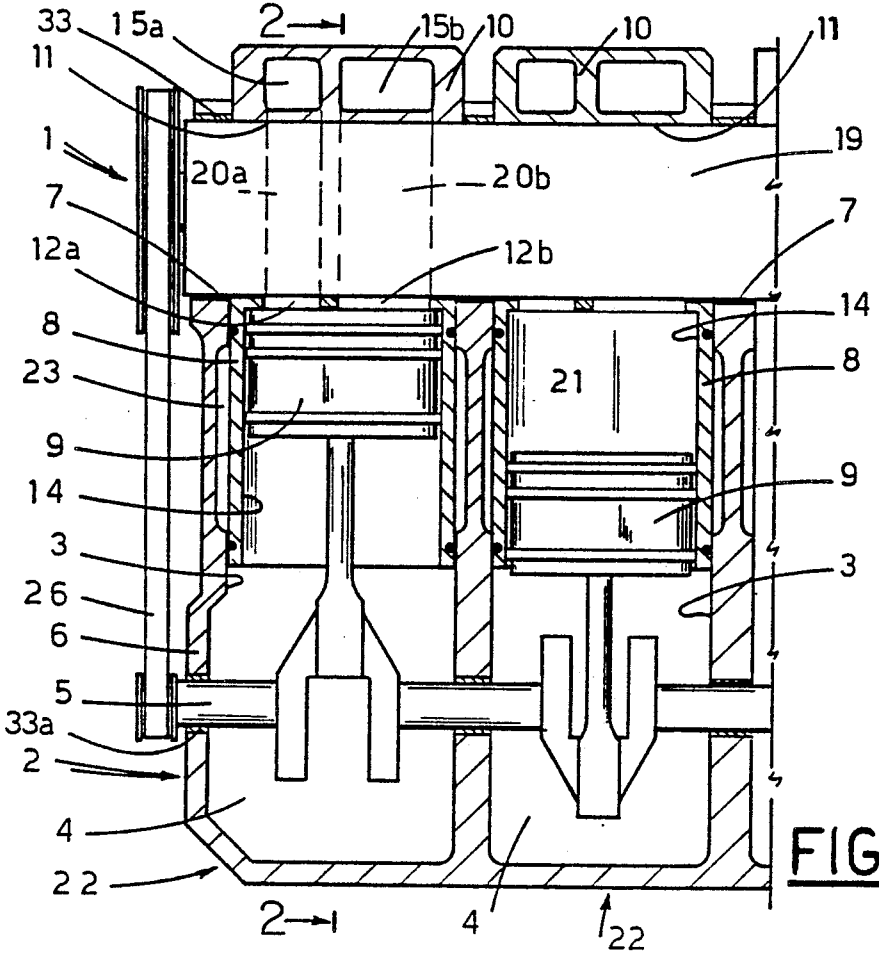
FIG. 1 is the longitudinal section through a four stroke engine according to the invention, from which certain non-essential components are omitted.

The hole 11 passing through each head 10 connects by way of respective ports 12 and 13 with the relative combustion chamber 21, and with one or more inlet and/or exhaust ducts 15 formed in and emerging externally of the head 10; the actual number of ducts 15 per single head 10 will depend substantially on the type of engine: a two stroke embodiment will have one exhaust duct 15*b* only (see FIG. 3), whereas the four stroke will have two inlet ducts 15*a* and two exhaust ducts 15*b* (FIG. 1). Each of the head castings 10 also affords at least one hole 18 extending from the outside wall toward the respective combustion chamber 21, which serves to accommodate means for igniting or injecting a combustible mixture in or into the chamber 2. In the example of FIGS. 1 and 2, the transverse dimensions of the head 10, normal both to the axis of the crankshaft 5 and to that of the bores 3, are greater than those of the crankcase 2, in such a way as to enable the fit illustrated in FIG. 2, in which the holes denoted 7 and 11 lie substantially coaxial with one another.

The valve element, or rotor 19, is cylindrical in embodiment and accommodated freely, to a precisely matched fit, by the coaxially disposed first and second holes 7 and 11 in the crankcase 2 and the heads 10. Accordingly, the valve rotor 19 functions additionally as a means by which the crankcase 2 and liner-head sections 8–10 are assembled one with the other, given that these are unable to separate once the respective holes 7 and 11 are occupied by the rotor 19. Thus, the dimensions of the holes 7 and 11 can differ only insofar as the first holes 7 will be required to accommodate means of supporting the combined assembler-and-valve rotor 19, namely bearings or shells, denoted 33 in the drawings, which are similar to the bearings 33*a* used for the crankshaft 5.

Figure 3:
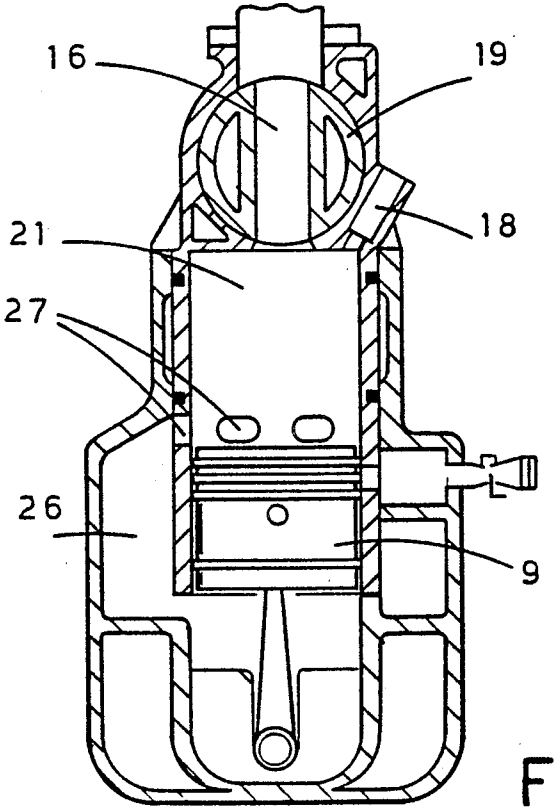
FIG. 3 is a further section through II—II of FIG. 1, illustrating a two stroke engine according to the invention.

The assembler-rotor 19 is pierced by at least one transverse passage 20 serving to connect the head ports 12 and 13 one with the other. Needless to say, the passages 20 will be equivalent in number to the pairs of ports 12 and 13. In the drawings, the transverse passages 20 are radially disposed, passing completely through the assembler-rotor 19 from side to side, and the ports 12 and 13 are located in diametrically opposed positions relative to the rotor; such an arrangement is shown by way of example, however, and implies no limitation. The assembler-rotor 19 is connected mechanically to the crankshaft 5, for example by way of a timing belt 25 as shown in FIG. 1, and its rotation thus synchronized with that of the crankshaft 5. The transmission ratio between the two rotating parts 5 and 19, in the case of the drawings, at least, will be 1:4 for a four stroke engine (FIGS. 1 and 2) and 1:2 for a two stroke (FIG. 3).

Whereas the construction of the engine 1 described thus far relates substantially to a four stroke embodiment, the two stroke embodiment differs only inasmuch as the combustion chamber 26 is located to one side, at the end of the liner 8 occupying the crankcase 2, and the liner 8 itself affords a plurality of inlet ports 27 that are uncovered by the piston 9 when at bottom dead center.

The engine according to the invention is provided further with cooling means of any given type, e.g. consisting in external fins, or in the case of the embodiment illustrated, a set of galleries through which liquid coolant is circulated. FIGS. 2 and 3 show a plurality of such galleries 17 formed in the head 10, a further pair of galleries 24 formed in the assembler-rotor 19, and a jacket 23 created between the inner surface of the crankcase 2 and the corresponding outer surface of each liner 8. In an i.c. engine thus embodied, the combined assembler-and-valve-rotor 19 performs a plurality of functions, namely:

that of a valve element capable, by simple rotary movement, of directing inlet and exhaust gases via the relative ducts 15 to and from the combustion chambers 21, and ensuring correct gas flow through the head;

that of exploiting a rotary coupling by means of which to connect a one-piece head-and-liner 10-8, replacing the equivalent discrete components of the conventional engine, to the crankcase 2, and thus eliminating a great number of more familiar single components, namely head gaskets, cylinder head bolts, and the timing system used for conventional poppet valve gear comprising camshafts, springs, rockers, tappets etc . . . ;

that of replacing the traditional reciprocating movement of several poppet valves with rotation of a single element;

that of ensuring an automatic sealing action in respect of compressed gases: in effect, each time the piston 9 is driven by the crankshaft 5 into its compression stroke, or returns in the opposite direction to allow expansion, a force is generated in the combustion chamber 21 that urges together and takes up the play between the heads 10 and the rotor 19; the force in question thus permits of ensuring a fluid-tight fit between the port 12 of the combustion chamber 21 and the rotor 19.

Thanks to this last-mentioned feature, the object stated at the outset is realized with extreme economy; the higher the pressure internally of the combustion chamber 21, then the more effective the sealing action obtained, and accordingly, one has an expedient substantially ensuring that mechanical clearances are taken up automatically.

Figure 5A:
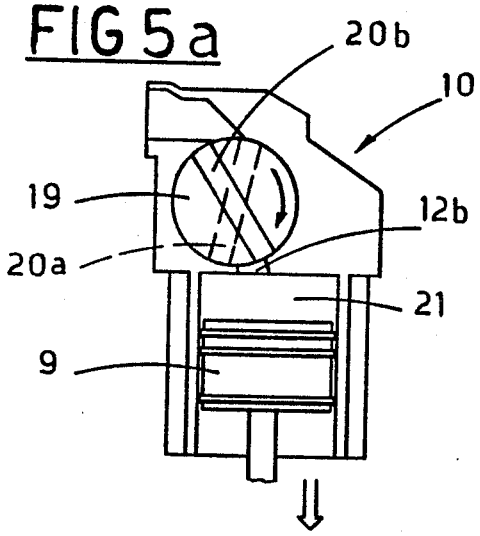
FIG. 5(*a–e*) shows the various stages in one cycle of a four stroke engine incorporating the valve rotor according to the invention.
Figure 5B:
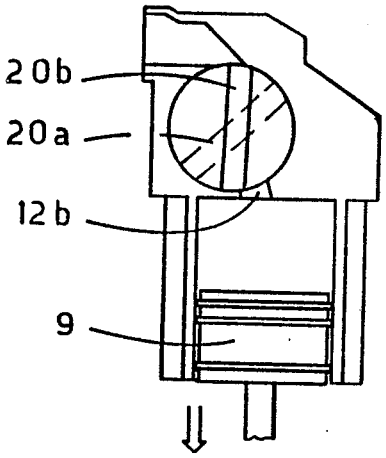
Figure 5C:
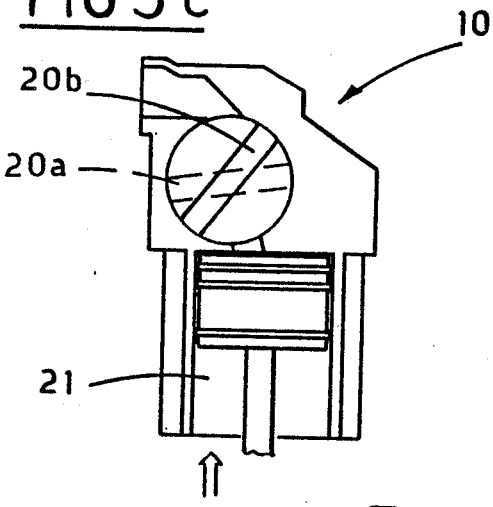
Figure 5D:
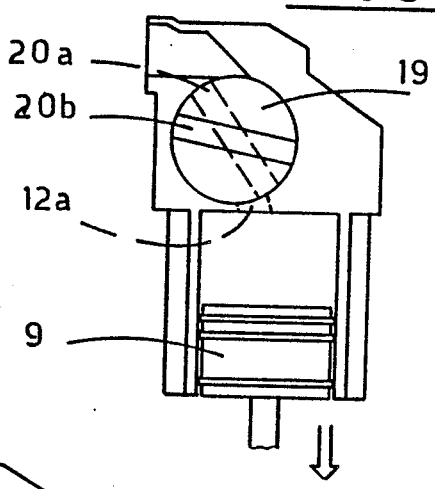
Figure 5E:
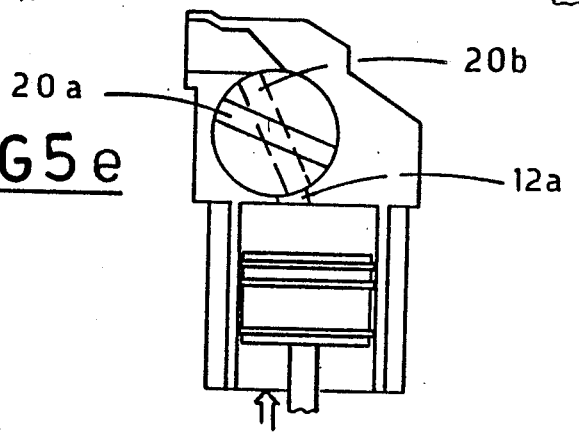

FIGS. 5*a* . . . 5*e* illustrate the respective positions taken up by the rotor 19 during movement of the piston 9, which are: induction, FIGS. 5*a* and 5*b;* compression-ignition, FIG. 5*c;* expansion, FIG. 5*d;* and exhaust, FIG. 5*e*. The inlet passage and inlet port are illustrated in bold line and denoted 20*b* and 12*b*, respectively, whereas the exhaust passage and port 20*a* and 12*a* are shown in phantom line. The simplicity of the engine's operation, which will be immediately apparent, is attributable to the particular architecture of the head and rotor assembly 10 and 19; by locating the valve passages 20*a* and 20*b* diametrically in the rotor 19, and staggering them at predetermined angular distances, it becomes possible to select the precise retard interval between the moments when the exhaust and inlet ports open and close. With four stroke timing obtained using a drive ratio of 1 to 4 between the crankshaft 5 and the valve rotor 19, it becomes possible to reach notably high running speeds for both the rotary components, hitherto inconceivable with traditional reciprocating valve gear.

What is claimed:

1. A rotary valve internal combustion engine, comprising:

a crankcase, affording at least one bore extending from an enclosure that is occupied by a crankshaft passing through and supported by the walls of the crankcase and disposed normal to the axis of the bore, of which the walls encompassing the bore afford at least one set of first coaxial cylindrical holes, located at the end of the bore farthest from the enclosure and disposed with axes parallel to that of the crankshaft;

at least one cylindrical liner accommodated slidably in each bore of the crankcase, of which the end farthest from the enclosure merges with a head exhibiting at least one set of transversely disposed second coaxial holes, substantially equal in diameter to the first coaxial holes of the crankcase, which, with the liner occupying the respective bore of the crankcase, combine with the first set of holes to form at least one continuous bore extending parallel to the crankshaft axis; wherein each liner affords an axial bore with one open end directed toward the crankshaft enclosure, slidably and tightly accommodating a relative piston that is connected mechanically to the crankshaft, and combining with the piston to create a relative combustion chamber, each of the second holes connects by way of relative ports with the respective combustion chamber and with one or more inlet and/or exhaust ducts formed in and emerging externally of the head, and the head affords at least one hole extending from the outside wall toward the respective combustion chamber, serving to accommodate means for igniting or injecting a combustible mixture in or into the respective combustion chamber;

at least one cylindrical valve element or rotor, accommodated rotatably internally of the first and second holes in the crankcase and the heads and providing means for assembly of the crankcase and head one with the other, connected mechanically to the crankshaft, and affording transverse passages designed to coincide cyclically with the inlet and exhaust ports.

2. A rotary valve engine as in claim 1, comprising a crankcase embodied in one or more modular units connectable one with the next, each provided with at least one bore extending from at least one relative enclosure and at least two cylindrical holes disposed coaxial with one each other and normal to the bore, wherein the crankshaft passes through and is supported by the walls of each modular unit, occupying the relative enclosure.

3. A rotary valve engine as in claim 1, comprising one set of first and second holes and one valve rotor only, wherein the transverse passages in the rotor and the ports in the head coincide diametrically.

4. A rotary valve engine as in claim 1, wherein the head associated with the single liner is provided with at least one internal gallery connecting with the gallery or galleries of the head adjacent, through which a flow of liquid coolant is directed.

5. A rotary valve engine as in claim 1, wherein each liner and the corresponding part of the crankcase combine to create a jacket through which a flow of liquid coolant is directed.

6. A rotary valve engine as in claim 1, wherein the valve rotor is provided with at least one gallery through which a flow of liquid coolant is directed.

7. A rotary valve engine as in claim 1, wherein the valve rotor is connected mechanically to the crank shaft by way of a timing belt.

8. A rotary valve engine as in claim 1, wherein the valve rotor is connected mechanically to the crank shaft by way of a chain drive.

9. A rotary valve engine as in claim 1, wherein the valve rotor is connected mechanically to the crank shaft by way of a train of gears.

10. A rotary valve engine as in claim 1, wherein the head associated with the cylindrical liner sections and/or crankcase are provided externally with cooling fins.

* * * * *